US005209686A

United States Patent [19]

Namur

[11] Patent Number: 5,209,686

[45] Date of Patent: May 11, 1993

[54] SEALING LIP OF PLASTIC FOR THE INLET OPENING FOR THE DAGGER BOARD HOUSING AND DAGGER BOARD, PARTICULARLY OF SAILBOARDS

[75] Inventor: Marc Namur, Darmstadt, Fed. Rep. of Germany

[73] Assignee: Schutz-Werke GmbH & Co. KG, Selters, Fed. Rep. of Germany

[21] Appl. No.: 756,967

[22] Filed: Sep. 9, 1991

[30] Foreign Application Priority Data

Sep. 8, 1990 [DE] Fed. Rep. of Germany ... 9012804[U]

[51] Int. Cl.[5] ..... B63B 35/79

[52] U.S. Cl. ..... 441/79; 114/130; 114/138

[58] Field of Search ..... 441/79; 114/130, 138

[56] References Cited

FOREIGN PATENT DOCUMENTS 3629777 6/1970 Fed. Rep. of Germany .

*Primary Examiner*—Sherman Basinger
*Assistant Examiner*—Thomas J. Brahan
*Attorney, Agent, or Firm*—Young & Thompson

[57] ABSTRACT

The lip-type seal for the inlet opening (2) for the dagger board housing and the dagger board (3) exhibits two supporting strips (5) countersunk into the board hull (4) on both sides of the inlet opening (2) as well as two mounting strips (7) with a sealing lip (8) for clamping onto the supporting strips (5), these mounting strips terminating with the profile (6) of the underwater hull and being fashioned as clamping strips. The mounting strip (7) is designed as an L-profile. Respectively one short, perpendicularly bent-away clamping leg (11, 12) is formed at the end edges of the long (9) and of the short leg (10) of the mounting strip (7). The sealing lip (8) adjoining the long leg (9) of the mounting strip (7) is formed, on its longitudinal side facing away from the mounting strip, into a rounded sealing edge (13) passing over into an elastic supporting leg (14) that is oriented obliquely upwardly, this supporting leg being attached to the end edge of the short leg (10) of the mounting strip (7). The sealing lip (8), together with the supporting leg (14) and the short leg (10) of the mounting strip (7), forms an elastic hollow-profile strip (23).

3 Claims, 2 Drawing Sheets

SEALING LIP OF PLASTIC FOR THE INLET OPENING FOR THE DAGGER BOARD HOUSING AND DAGGER BOARD, PARTICULARLY OF SAILBOARDS

FIELD OF THE INVENTION

The invention relates to a lip-type seal of a synthetic resin for the lower closure of the inlet opening for the dagger board housing and the dagger board, especially in case of sailboards, with respectively one mounting strip of a hard synthetic resin attached on each side of the opening for housing the dagger board casing and the inwardly swung dagger board and being flush with the profile of the hull below the waterline, and with a sealing lip of an elastic synthetic resin, produced together with this mounting strip as an extruded profile, wherein the sealing lips form an elastic closure for the inlet opening for the dagger board housing and the dagger board, as well as with a supporting strip of a synthetic resin countersunk into the board hull on each side of the inlet opening and fastened in this board hull, for fixedly clamping a mounting strip with a sealing lip.

BACKGROUND OF THE INVENTION

It has been found under practical conditions that the sealing action of such a lip-type seal, known from DE 3,629,777 C2, is not optimal.

The invention is based on the object of developing a lip-type seal for the dagger board housing and the inlet opening for the dagger board in sailboards with a sealing effect that is improved over the lip-type seal of this structure.

SUMMARY OF THE INVENTION

The lip-type seal of this invention is completely tight, on account of its optimum rigidity, against water pressure in the inwardly and outwardly swung position of the dagger board. The mounting strip with the sealing lip exhibits a surface favorable from the viewpoint of flow dynamics. Finally, the mounting strip, designed as a clamping strip, with the sealing lip can be manufactured in a very economical way since the mounting strip of a hard plastic, e.g. polyvinyl chloride, and the sealing lip of a soft plastic, e.g. polyurethane, can be extruded simultaneously from these relatively inexpensive materials with an appropriate design of the extruder die, and the two different plastics bond firmly to each other during the curing step.

BRIEF DESCRIPTION OF THE DRAWINGS

The invention will be described in detail below with reference to an embodiment illustrated in the drawing wherein.

DETAILED DESCRIPTION OF THE INVENTION

Figure 1:
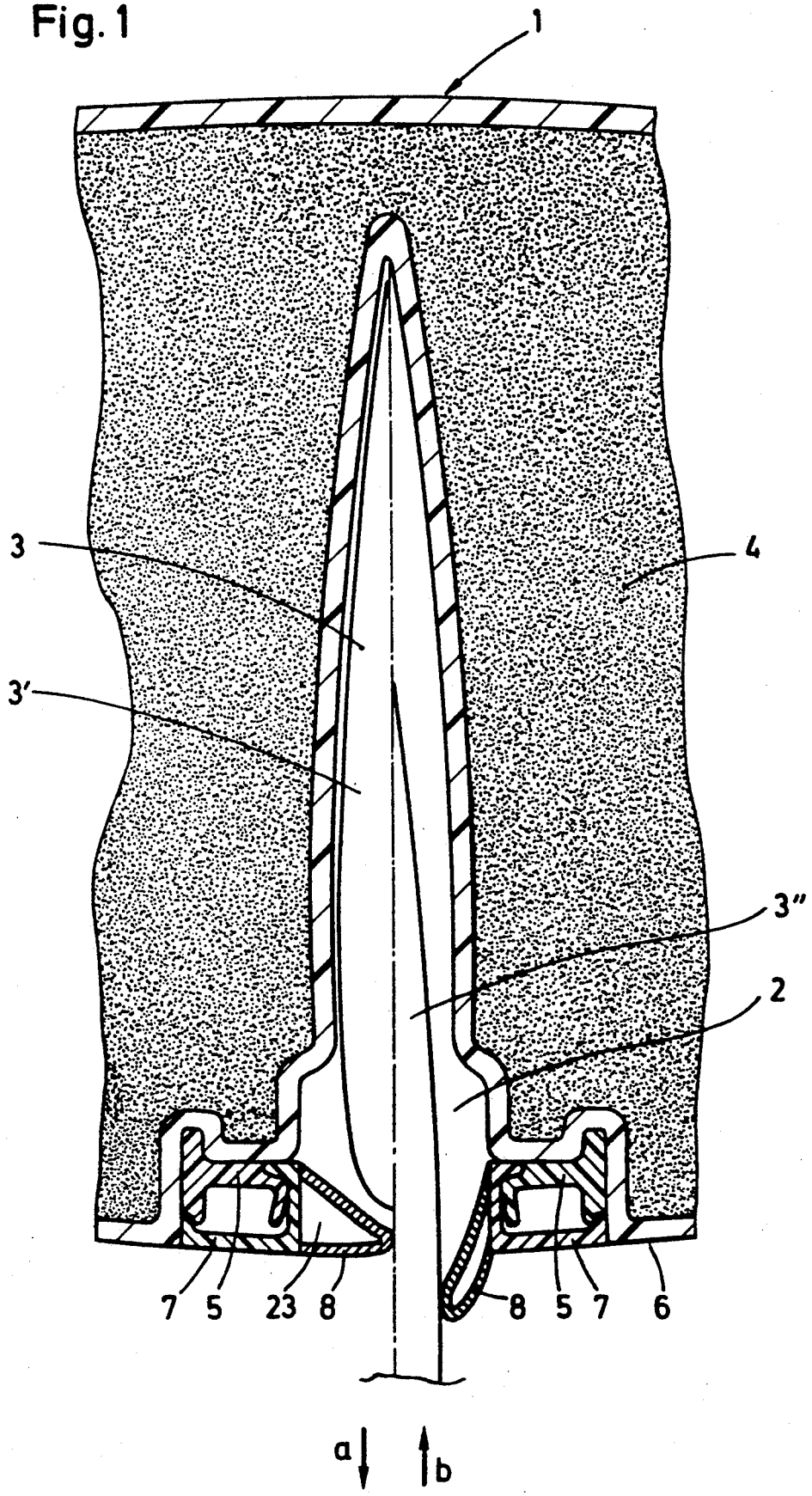
FIG. 1 is a cross section of the lip-type seal outside of the dagger board housing with the dagger board being swung inwards and outwards.
Figure 2:
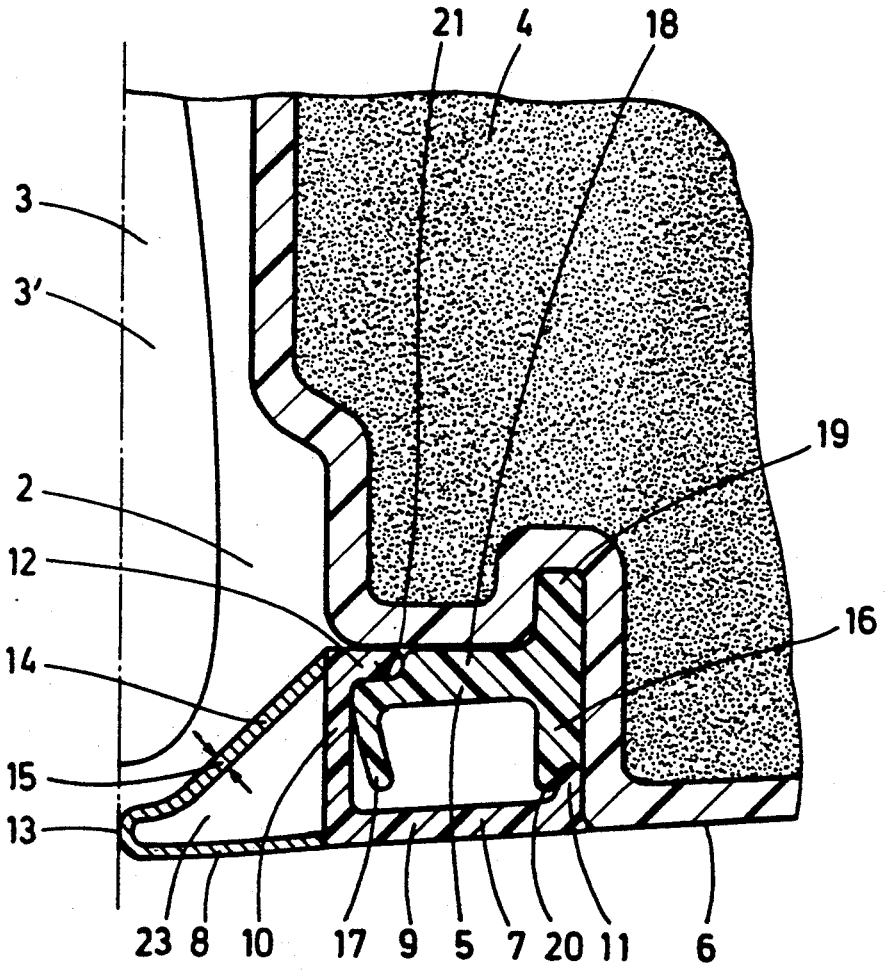
FIG. 2 is an enlarged cross-sectional view of the mounting strip with sealing lip, clamped onto the supporting strip.

The lip-type seal for the dagger board housing, not shown, of a sailboard 1 exhibits two supporting strips 5, countersunk into the board hull 4 on both sides of the inlet opening 2 for the dagger board housing and the folded-in dagger board 3, as well as two mounting strips

7 flush with the profile 6 of the underwater hull and designed as clamping strips, these mounting strips having an elastic sealing lip 8 for clamping onto the supporting strips 5.

The mounting strip 7 is designed as an L-profile. The mounting strip 7 respectively includes one short, vertically bent-away clamping leg 11 molded to the end edges of a long leg 9 and another short bent-away clamping leg molded to the end edges of a short leg 10. The sealing lip 8 adjoining the long leg 9 of the mounting strip 7 is shaped, on its longitudinal side facing away from the mounting strip, into a rounded sealing edge 13 passing over into an elastic supporting leg 14 oriented obliquely in the upward direction; this supporting leg is attached to the terminal edge of the short leg 10 of the mounting strip 7. The supporting leg 14, which is more rigid than the sealing lip 8, exhibits a greater thickness 15 than the sealing lip.

Respectively one mounting strip 7 of a hard synthetic resin, e.g. polyvinyl chloride, and one sealing lip 8, as well as a supporting leg 14, of an elastic synthetic resin, such as polyurethane, are produced jointly as an extruded profile.

The supporting strip 5 is designed as a U-profile with two short legs 16, 17 and a connecting web 18. The leg 16, adjoining the web 18 at a right angle, has an extension 19 projecting past the connecting web 18 and exhibits a shoulder 20 at its free end. The other leg 17 of the supporting strip 5 is bent slightly toward the inside, and the connecting web 18 has a shoulder 21 in the transitional region toward the oblique leg 17.

The supporting strips 5, consisting of a hard plastic, such as polyvinyl chloride, are bonded to the dagger board housing by gluing and are glued into the board hull 4 outside of the dagger board housing.

When the mounting strip 7 with the sealing lip 8 is clamped onto the supporting strip 5, the clamping leg 11 at the long leg 9 of the mounting strip slides onto the shoulder 20 of the straight leg 16 of the supporting strip 5, and the clamping leg 12 at the short leg 10 of the mounting strip 7 slides over the oblique leg 17 of the supporting strip 5 and hooks in place on the shoulder 21 of the connecting web 18 of the supporting strip 5.

The sealing lip 8 forms, together with the supporting leg 14 and the short leg 10 of the mounting strip 7, an elastic hollow-profile strip 23, the rigidity of which in the unfolding direction a of the dagger board 3 is lower than in the inward-folding direction b of the dagger board. This mode of operation of the sealing lip 8 integrated into the hollow-profile strip 23 ensures that the two sealing lips 8 of the lip-type seal constitute an elastic, tight closure of the opening for accommodating the dagger board housing and the dagger board 3 in the inwardly folded 3' and in the outwardly folded position 3'' of the dagger board 3, wherein the sealing effect of the lip-type seal is ensured by the rigidification of the sealing lips 8 with the aid of the supporting legs 14, even in case of a high water pressure to which the underwater hull is exposed during high waves. The rigidity of the sealing lip 8, diminished in the unfolding direction a of the dagger board 3, ensures a central smooth operation of the dagger board 3 so that the manual strength required for unfolding the dagger board can be generated by any sailboarder, and the operating force, increasing during the inward folding of the dagger board on account of the higher rigidity of the sealing lips 8 in the inward-folding direction b, can be readily applied by any sailboarder due to the possibility of manipulating the dagger board with one's foot.

In case of damage to the sealing lip 8, the mounting strip can be removed and exchanged, simply by releasing the clamping seal between the mounting strip 7 and the supporting strip 5.

I claim:

1. A lip seal assembly for a bottom closure of an inlet opening in a board hill for dagger board housing and dagger board, comprising: one mounting strip of a hard synthetic resin attached respectively on each side of the inlet opening in the board hull and being flush with the profile of the hull, and a sealing lip of an elastic synthetic resin, manufactured together with said mounting strip as an extruded profile, said sealing lips forming an elastic closure for the inlet opening for the dagger board housing and the dagger board, as well as with a supporting strip of a synthetic resin countersunk into the board hull on each side of the inlet opening and fastened to said board hull, for fixedly clamping a mounting strip with a sealing lip, said mounting strip having an L-profile, and including one long leg adjoining one short leg, and one perpendicular bent-away clamping leg formed at an end edge of the long leg and another perpendicularly bent away clamping leg formed at an end edge of the short leg, said sealing lip adjoining said long leg of the mounting strip being shaped, on a longitudinal side facing away from the mounting strip, into a rounded sealing edge passing over into an elastic support leg, said supporting leg being oriented obliquely upwardly and being attached to a terminal edge of the short leg and constituting with said short leg and with said sealing lip an elastic hollow-profile strip; and said mounting strip being fixedly clamped with said clamping legs onto the supporting strip.

2. The lip seal assembly according to claim 1, wherein the supporting leg is more rigid than the sealing lip, and has a greater thickness than the sealing lip.

3. The lip seal assembly according to claim 1, wherein the supporting strip has a U-profile with two legs and a connecting web, one of said legs of said supporting strip being straight and having an extension projecting past the connecting web and having a shoulder at its free end, the other of said legs of said supporting strip being oblique and slightly bent inwardly; said connecting web having a shoulder in a transitional zone toward the oblique leg so that during the clamping of the mounting strip with the sealing lip onto the supporting strip, the clamping leg at the long leg of the mounting strip slides onto the shoulder of the straight leg of the supporting strip, and the clamping leg at the short leg of the mounting strip slides over the oblique leg of the supporting strip and hooks in place on the shoulder of the connecting web of the supporting strip.

* * * * *